United States Patent [19]

Zhivotchenko et al.

[11] Patent Number: 5,029,575

[45] Date of Patent: Jul. 9, 1991

[54] WALKING-SIMULATING APPARATUS FOR PERSONS WITH RESTRICTED MOBILITY

[76] Inventors: Vladimir D. Zhivotchenko, ulitsa Vinokurova, 7/5, korpus 3, kv. 30; Galina V. Ljubimova, ulitsa Planetnaya, 18, kv. 91; Alexandr S. Mirkin, ulitsa Bakinskaya, 14, kv. 67; Evgeny A. Monakhov, ulitsa Krupskoi, 19, kv. 164; Vladimir V. Nazarov, Novoyasenevsky prospekt, 12, korpus 3, kv. 37, all of Moscow, U.S.S.R.

[21] Appl. No.: 239,951

[22] PCT Filed: Oct. 24, 1986

[86] PCT No.: PCT/SU86/00107

§ 371 Date: Jun. 2, 1988

§ 102(e) Date: Jun. 2, 1988

[87] PCT Pub. No.: WO88/03038

PCT Pub. Date: May 5, 1988

[51] Int. Cl.[5] ..... A61H 1/00

[52] U.S. Cl. ..... 128/25 B; 36/97; 128/582

[58] Field of Search ..... 128/24.2, 25 B, 25 R, 128/581, 582, 32; 36/97, 11.5

[56] References Cited

U.S. PATENT DOCUMENTS

| | | | |
|---|---|---|---|
| 2,255,066 | 9/1941 | Lamb | 128/25 B |
| 2,397,428 | 3/1946 | Moshier | 128/25 B |
| 2,700,832 | 2/1955 | Slovinski | 128/581 |
| 3,683,896 | 8/1972 | Peplin | 128/24.2 |
| 4,083,128 | 4/1978 | Rossman | 36/97 |

OTHER PUBLICATIONS

Russian Publication, pp. 26–29, 1982.

*Primary Examiner*—Edgar S. Burr
*Assistant Examiner*—Moshe I. Cohen
*Attorney, Agent, or Firm*—Burgess, Ryan & Wayne

[57] ABSTRACT

The apparatus incorporates two platforms (1) resting whereon are the feet and mechanical vibrators (2–5) located pairwise on each platform (1) so as to exert their action on the bearing surfaces of both feet. Each of the platforms has a fore and a rear housing (6,7) which can be translated relatively to each other due to a mechanical actuator.

4 Claims, 2 Drawing Sheets

WALKING-SIMULATING APPARATUS FOR PERSONS WITH RESTRICTED MOBILITY

Industrial Field

The invention relates to medical instruments and equipment and has specific reference to walking-simulating apparatus for persons with restricted mobility.

BACKGROUND OF THE INVENTION

It is well known that in cases of restricted (impaired) mobility the bearing surfaces of the soles of the feet are not exposed to the effect of normal walking when these surfaces, the Achilles tendon and other structures taking part in the movement are stimulated at regular intervals concurrently with the rhythm of walking.

Lack of stimulant for mechanoreceptors leads to problems in static and kinetic control.

There is known a method of keeping or simulating orthostatic balance in cases of restricted (impaired) locomotion according whereto the body of a man is linked to a supporting means by a resilient link and exposed to inertial shock loads of short duration applied along the body's longitudinal axis so as to overcome the elastic forces of the link (cf. USSR Inventor's Certificate No. 256164, IPC A 61 H 1/00, Bulletin "Discoveries, Inventions, Industrial Designs and Trade Marks" No. 25, 1976; Inventors: V. V. Bazhanov, A. V. Eremin, V. I. Stepanov, L. P. Salmanov and V. A. Titler).

Also known is a walking-simulating apparatus for persons suffering from restricted mobility of various degree consisting of two platforms which give support to the feet and are provided with vibrators located so as to exert their action on the bearing surfaces of both soles. The platforms are attached to the feet by some sort of binding. The apparatus is provided with a programmed means of sequential control of the vibrators triggered in accordance with human walking pattern (Journal of neuropathology and psychiatry named after S. S. Korsakov, issue 8, Moscow, Meditsina Publishers, 1982 (in Russian) pp. 26–29 (1146–1149), "Application of vibro-stimulating footwear in complex treatment of postinsult patients" by I. V. Manekchina, A. S. Mirkin, L. G. Turbina, A. N. Vavilin, V. P. Ivannikov, L. A. Ivannikova, T. S. Ionova, V. K. Belokudrin).

The known apparatus lacks a means of accurately positioning the vibrators next to the bearing surfaces of the feet nd is incapable of stimulating the Achilles tendon. The stimulation of the bearing surfaces of the feet is poor, and the remedial effect of the apparatus is low.

Moreover, the soles are sites of numerous nerve endings and a misplaced vibrator can be an evil rather than asset, causing damage to organs.

SUMMARY OF THE INVENTION

The object of the invention is to provide a walking-simulating apparatus for person with restricted mobility wherein the platforms upon which the feet rest are of an improved design owing to which the bearing surfaces of the feet of any size are acted upon directly.

This object is realized by a walking-simulating apparatus for persons with restricted mobility incorporating two platforms upon which the feet rest and at least four mechanical vibrators located pairwise on each platform so as to exert their action on the bearing surfaces of both feet wherein according to the invention each of the platforms has a fore and a rear housing which can be translated relative to each other due to a mechanical actuator and a means of setting a distance between the fore and rear housings which is interlinked with the mechanical actuator.

It is expedient to provide each of the rear housings with an ankle piece attached thereto with provision for displacing up and down along the Achilles tendon there is a mechanical vibrator exerting its action on the Achilles tendon.

The mechanical actuator and the means of setting the distance between the fore and rear housings interlinked therewith can be provided in the form of a screw pair secured to the corresponding platform.

The apparatus can also be provided with a means of setting at least one of the mechanical vibrators on each of the fore housings into an appropriate position with respect to the bearing surfaces of the foot which is fitted to the fore housing at a side opposite to the corresponding rear housing.

The disclosed apparatus is an effective tool for the management of disorders bringing about restricted (impaired) mobility.

BRIEF DESCRIPTION OF THE DRAWINGS

A preferred embodiment of the invention will now be described by way of example with reference to the accompanying drawings wherein.

DETAILED DESCRIPTION OF THE INVENTION

The disclosed walking-simulating apparatus for persons with restricted mobility is designed to rehabilitate patients after a cerebral hemorrhage. It may also find application as a means of prophylaxis.

The apparatus consists of two identical platforms 1 (FIGS. 1,2) each whereof gives support to a patient's foot. In what follows only one platform 1 is described but it must be kept in mind that the disclosed features of the design of this platform refer to the other platform as well. Each of the platforms 1 is fitted with at least two mechanical vibrators which exert their action on the front and rear parts of the foot, within its bearing surfaces.

Figure 2:
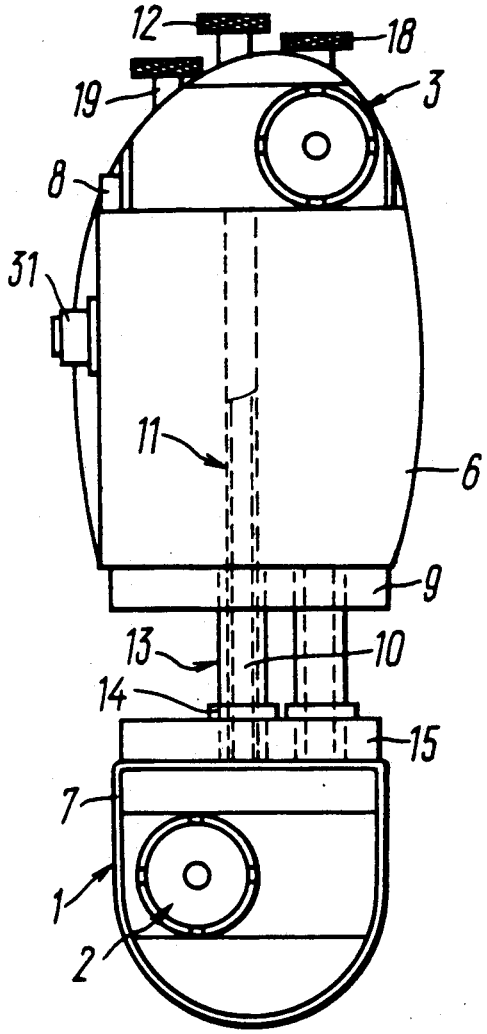
FIG. 2 is a plan view of the same apparatus according to the invention.
Figure 1:
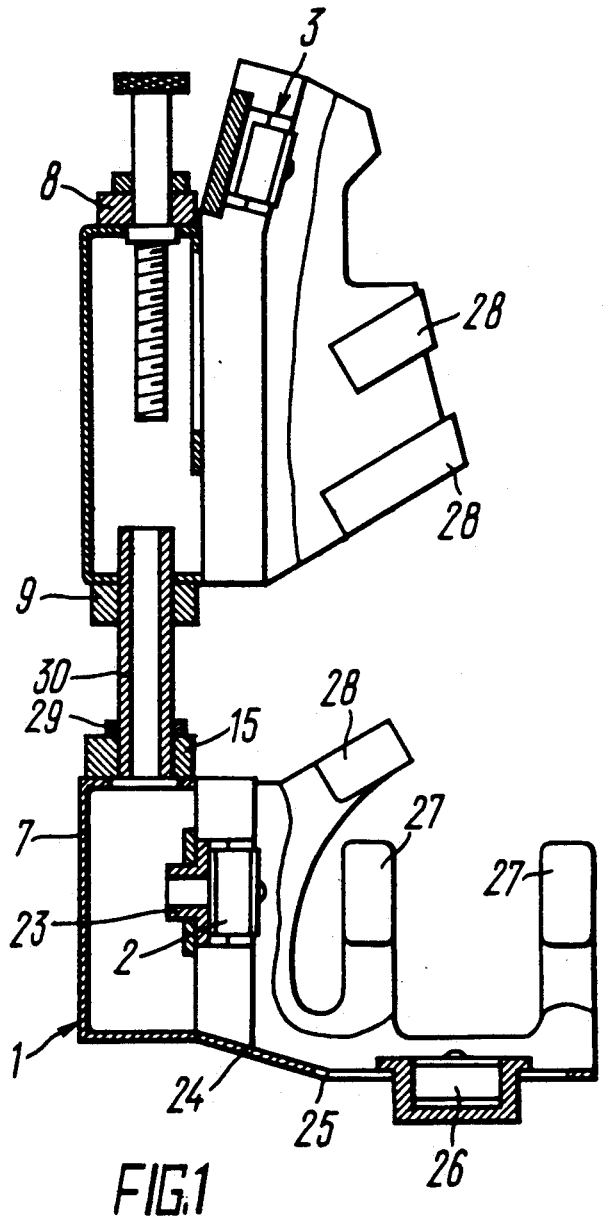
FIG. 1 is a sectional elevation of the walking-simulating apparatus according to the invention.
Figure 3:
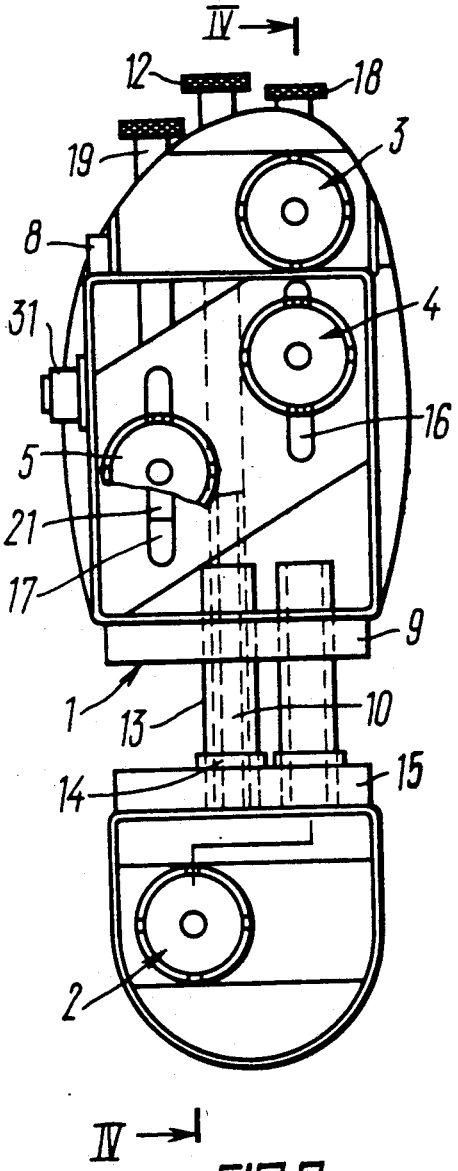
FIG. 3 is a plan view of the same apparatus in another embodiment of the invention.
Figure 4:
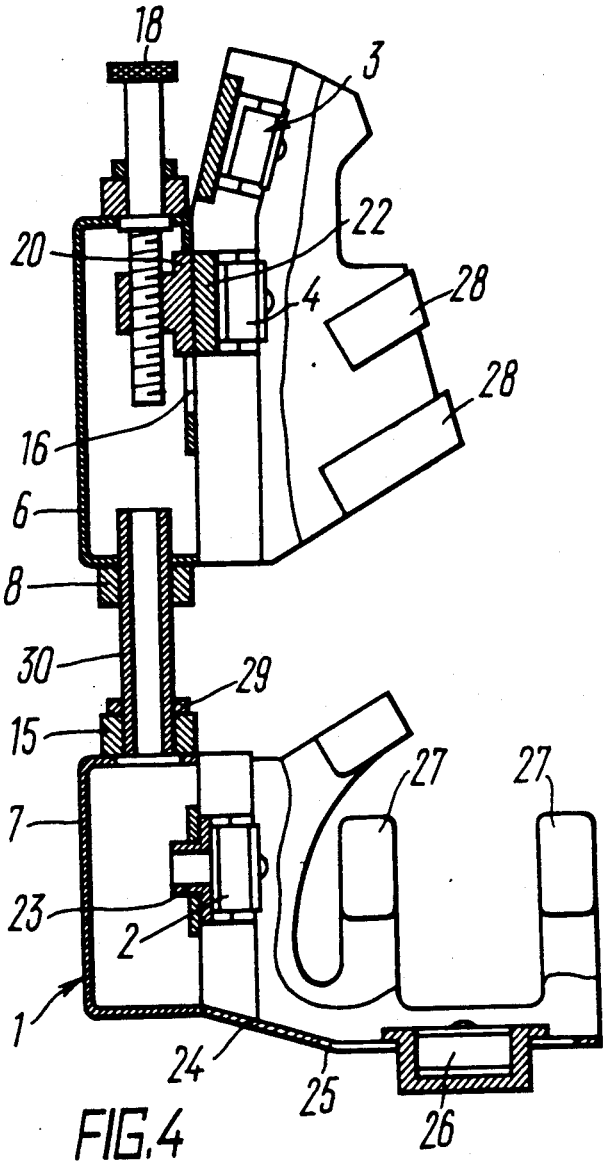
FIG. 4 is a section on line IV—IV of FIG. 3.

Referring to FIGS. 1 and 2 illustrated therein is am embodiment of the invention which features two vibrators 2, 3 on each platform. The number of the vibrators is decided by the physiological and functional aspects of walking. Accordingly, there are four principal bearing surfaces: at the heel, at the big toe, the lateral and medial pads in the forward part of the foot. FIGS. 3,4 illustrate an embodiment of the invention according wherein each of the platforms 1 has four vibrators: a vibrator in the bearing surface of the heel shown at 2, a vibrator in the region of the big toe shown at 3 and vibrators in the lateral and medial zones of the forward part of the foot which are shown at 4 and 5, respectively.

The vibrators 2 through 5 are positioned on the platform 1 so as to contact the respective bearing zones of the foot when this is placed on the platform 1.

The platform 1 is of the built-up type, comprising a fore housing 6 (FIG. 1) and a rear housing 7 which can fit the foot of any size for effective treatment. The vibrator 2 is located on the rear housing 7 and the rest of the vibrators 3 through 5 (FIG. 1) are sited on the fore housing 6.

The housings 6,7 can be displaced relative to each other. To that end they are provided with a mechanical actuator which has a means of setting the distance between the housings 6,7 in the form of a screw pair. The fore housing 6 has a plate 8 and a guide 9. The screw pair consisting of a screw 10 and a threading 11 in the housing 6 and in the guide 9 of the housing 6 imparts translation motion to the housing 6 with respect to the rear housing 7.

For setting distance between the housings 6 and 7, use is made of a knob 12 linked to the screw 10 which passes through a sleeve 13 attached to plates 14,15 of the rear housing 7.

The vibrator 3 is immovably attached to the housing 6, and the vibrators 4 (FIGS. 3,4) and 5 can change their position on the housing 6.

This is accomplished by fitting the vibrators 4,5 to slide blocks 20,21 which can travel along slots 16,17, the vibrators 4,5 being operatively connected to screws 18 and 19. Such means of setting the vibrators 4,5 into appropriate positions renders the apparatus fit for use by patients whose feet can be of any size.

Fingered bushings 22 are used to hold fast the vibrators 4 and 5 in the housing 6, being rigidly attached to the slide blocks 20, 21 set into motion by the screws 18, 19, respectively. The vibrator 2 is attached to the housing 7 by a fingered bushing 23.

The rear housing 7 has an ankle piece 24 (FIG. 1) with a slot 25 accommodated wherein is a mechanical vibrator 26 which can be positioned at any point along the Achilles tendon by being shifted manually along the slot 25. The ankle piece 24 is held fast to the patient's shank by an adhesive binding 27. Similar bindings 28 are provided on the housings 6 and 7.

A receptacle 31 is provided on the front housing 6 and conductors (not shown) are run therefrom to the rear housing 7 via a sleeve 30 held fast by collar plates 15, 29.

The disclosed apparatus is used in the following way.

The bearing surfaces of the feet are located by any known technique (e.g. by vibration tests, using an Achilles tendon-stimulating vibrator), and the platform 1 is set for a given size, as determined by the location of the bearing surfaces, by shifting the housing 6 with respect to the housing 7 with the aid of the screw 10. The vibrators 4,5 are set within the projections of the located bearing surfaces by the screws 18,19, and the apparatus is affixed to the foot by bindings 28 so as to exert an appropriate pressure on the sole. The ankle piece 24 secured to the platform 1 and the bindings 27 applied to the leg permit accurate positioning of the foot and Achilles tendon so that the vibrators 2 through 5 come within the projections of the bearing surfaces and the Achilles tendon. Once the apparatus is secured to the feet and legs, it is connected to a programming means (not shown) which triggers the vibrators 2 through 5 concurrently with human walking pattern and with due allowance for the time-dependent variables of the process of locomotion.

The disclosed apparatus of the vibration-stimulating type is characterized by a high accuracy of stimulation of the bearing surfaces. The apparatus is compact, simple in operation and causes no discomfort to the patient during treatment.

The period of in-patient cure at a hospital is cut from 21 days to 17–18 days for patient with impaired locomotion owing to the disclosed apparatus.

INDUSTRIAL APPLICABILITY

The invention can be of utility in the care of patients suffering from restricted (impaired) locomotion, bringing about partial compensation of sensory deficiency and other functional disorders resulting from restricted mobility.

We claim:

1. A walk-simulating apparatus for persons with restricted mobility comprising:

(a) a forward and a rearward housing;

(b) a forward platform mounted on the forward housing and a rearward platform mounted on the rearward housing, said platforms/supporting a foot of a person;

(c) at least a pair of mechanical vibrators in operative engagement with the forward platform and a single vibrator in operative engagement with the rearward platform, each of said vibrators adapted to transmit vibrational energy directly to the bearing surfaces of the respective foot of the user;

(d) actuator means for changing the distance between the forward and rearward housings; and (e) means connected to the actuator means for setting the distance between the forward and the rearward housings.

2. The apparatus of claim 1 further comprising an ankle support means attached to the rear housing and including a mechanical vibrator adapted to transmit vibrational energy to the Achilles tendon of the ankle of the user.

3. The apparatus of claim 1 wherein the means for setting the distance between the forward and the rearward housing comprises screw means secured to said platforms.

4. The apparatus of claim 1 further comprising means for setting the position of the mechanical vibrators in operative engagement to the bearing surfaces of the foot, said setting means being attached to the forward housing at a side opposite to the rearward housing.

* * * * *